US009481172B2

(12) United States Patent
Hirai

(10) Patent No.: US 9,481,172 B2
(45) Date of Patent: Nov. 1, 2016

(54) LIQUID EJECTION APPARATUS AND A METHOD FOR PRODUCING LIQUID EJECTION APPARATUS

(71) Applicant: BROTHER KOGYO KABUSHIKI KAISHA, Nagoya-shi, Aichi-ken (JP)

(72) Inventor: Keita Hirai, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/664,147

(22) Filed: Mar. 20, 2015

(65) Prior Publication Data

US 2015/0273831 A1 Oct. 1, 2015

(30) Foreign Application Priority Data

Mar. 26, 2014 (JP) ..... 2014-063832

(51) Int. Cl.

*B41J 2/015* (2006.01)
*B41J 2/14* (2006.01)
*B41J 2/16* (2006.01)

(52) U.S. Cl.

CPC ..... *B41J 2/14201* (2013.01); *B41J 2/14233* (2013.01); *B41J 2/1607* (2013.01); *B41J 2002/14459* (2013.01); *B41J 2002/14491* (2013.01); *B41J 2202/20* (2013.01)

(58) Field of Classification Search

None

See application file for complete search history.

(56) References Cited

U.S. PATENT DOCUMENTS

2006/0055742 A1 3/2006 Yokouchi
2007/0035589 A1 2/2007 Takahashi et al.
2007/0052764 A1 3/2007 Oku
2008/0218556 A1* 9/2008 Seto ..... B41J 2/14233 347/50
2010/0156997 A1 6/2010 Young et al.
2012/0320131 A1 12/2012 Kato et al.

FOREIGN PATENT DOCUMENTS

| | | | |
|---|---|---|---|
| CN | 102825911 | A | 12/2012 |
| EP | 1 997 637 | A1 | 12/2008 |
| EP | 2 535 189 | A1 | 12/2012 |
| JP | 2006-082343 | A | 3/2006 |
| JP | 2007-045129 | A | 2/2007 |
| JP | 2008-044294 | A | 2/2008 |

OTHER PUBLICATIONS

Extended European Search Report issued in related application No. EP 15160852.8 on Aug. 25, 2015.

Office Action issued in related Chinese Patent Application No. 201510135037.X, Mar. 3, 2016.

* cited by examiner

*Primary Examiner* — Erica Lin

(74) *Attorney, Agent, or Firm* — Merchant & Gould P.C.

(57) ABSTRACT

A liquid ejection apparatus comprising: a nozzle; a first channeled structure defining a first liquid channel, the first liquid channel communicating with the nozzle; a second liquid channel; a communication opening connecting the first liquid channel and the second liquid channel; a laminated body including a piezoelectric element and a metal layer, the laminated body having a first portion supported by the first channeled structure and a second portion extending over the first liquid channel and not supported by the first channeled structure, the communication opening extending through the second portion of the laminated body such that the second portion surrounds the communication opening; wherein the second portion of the laminated body includes the metal layer surrounding the communication opening.

11 Claims, 8 Drawing Sheets

LIQUID EJECTION APPARATUS AND A METHOD FOR PRODUCING LIQUID EJECTION APPARATUS

CROSS-REFERENCE TO RELATED APPLICATION

This application claims priority from Japanese Patent Application No. 2014-063832 filed on Mar. 26, 2014, which is incorporated herein by reference in its entirety.

FIELD OF DISCLOSURE

The disclosure relates to a liquid ejection apparatus configured to eject liquid and a method for producing the liquid ejection apparatus.

BACKGROUND

A known liquid ejection apparatus, e.g., an inkjet head, is configured to eject ink from a plurality of nozzles. The inkjet head includes a channeled substrate and a reservoir formation substrate. The channeled substrate includes a plurality of pressure chambers and a communication portion that is shared by the pressure chambers and communicates with the pressure chambers. A laminated body including a plurality of layers is disposed at the upper surface of the channeled substrate. The laminated body includes a vibration plate covering the pressure chambers and a plurality of piezoelectric elements corresponding to the pressure chambers. A nozzles plate is disposed at a surface of the channeled substrate opposite to the laminated body, e.g., the lower surface of the channeled substrate. The nozzles plate has the nozzles configured to communicate with the pressure chambers in the channeled substrate.

The reservoir formation substrate is disposed above the channeled substrate to cover the piezoelectric elements included in the laminated body. The reservoir formation substrate is bonded to the laminated body with an adhesive in an area outside the piezoelectric elements. The reservoir formation substrate includes a reservoir portion. The reservoir portion communicates with the communication portion of the channeled substrate, via a communication opening formed on the laminated body. Ink supplied in the communication portion of the channeled substrate from the reservoir portion is distributed to each of the pressure chambers.

SUMMARY

According to an aspect of the disclosure, a liquid ejection apparatus includes a nozzle and a first channeled structure defining a first liquid channel that communicates with the nozzle. A communication opening connects the first liquid channel and a second liquid channel. A laminated body has a piezoelectric element and a metal layer, and a first portion of the laminated body is supported by the first channeled structure and a second portion extends over the first liquid channel and thus is not supported by the first channeled structure. The communication opening extends through the second portion of the laminated body such that the second portion surrounds the communication opening. The second portion of the laminated body includes the metal layer surrounding the communication opening.

BRIEF DESCRIPTION OF THE DRAWINGS

Reference now is made to the following description taken in connection with the accompanying drawings.

DETAILED DESCRIPTION

In some known liquid ejection apparatuses, a portion of the laminated body around the communication opening (hereinafter, referred to as the circumferentially facing portion) partially faces an ink channel in the channeled substrate. In other words, the circumferentially facing portion is disposed around the communication opening without being supported by the channeled substrate. When external force is applied to the circumferentially facing portion due to various factors, the circumferentially facing portion is susceptible to damages. For example, the circumferentially facing portion is positioned around the communication opening, so that pressure of liquid flowing into the communication opening is applied to the circumferentially facing portion. When the reservoir formation substrate is bonded to a portion of the laminated body around the communication opening with an adhesive, shrinkage force of the adhesive may be applied to the circumferentially facing portion. Further, when the vibration plate is vibrated due to the driving of the piezoelectric elements, the vibration is applied to the circumferentially facing portion.

One or more aspects of the disclosure includes preventing or reducing damages on a circumferentially facing portion that is disposed at a portion of a laminated body around a communication opening and faces or opposes a channel formed in a channeled structure.

Figure 1:
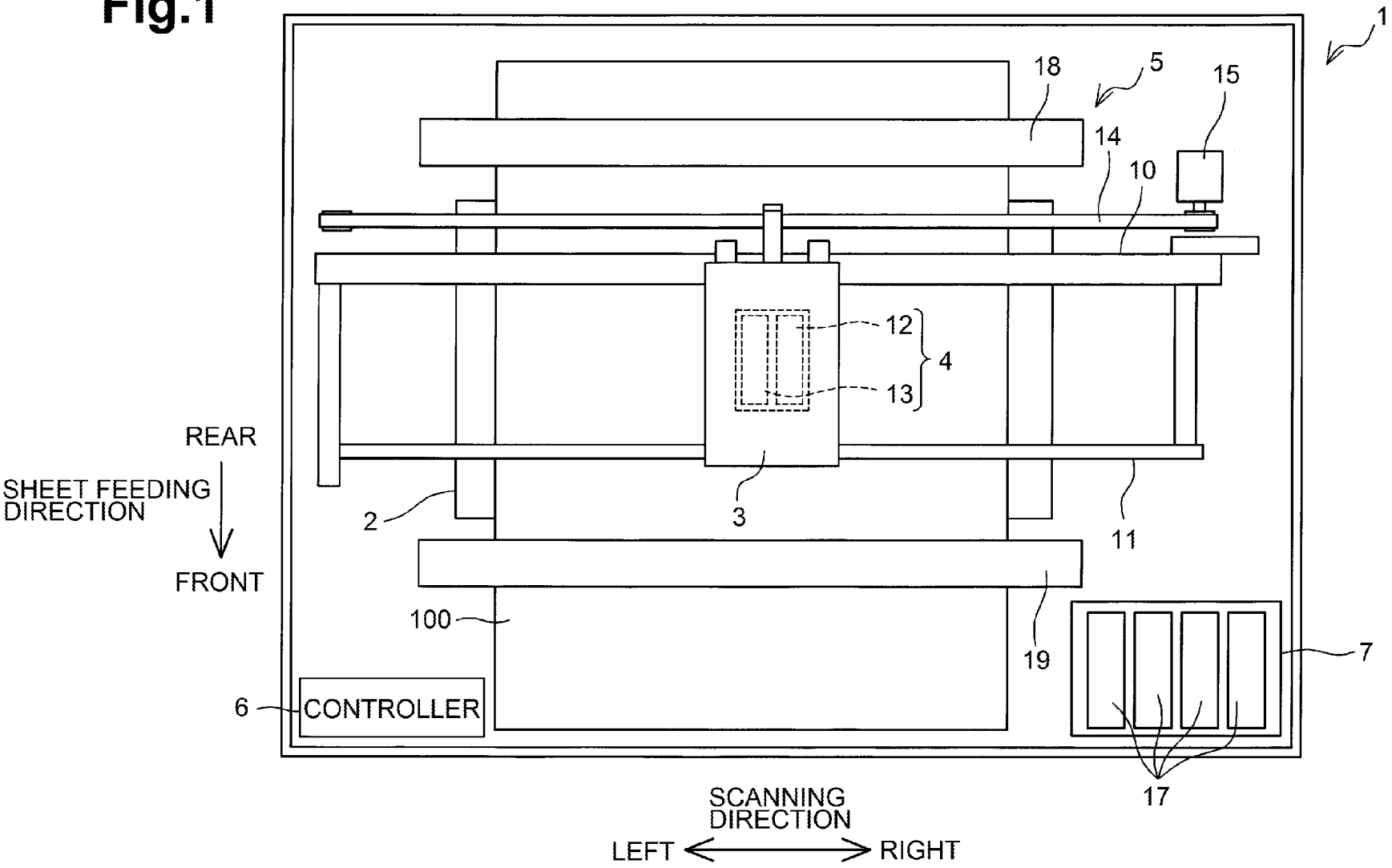
FIG. 1 is a plan view of a printer in an illustrative embodiment according to one or more aspects of the disclosure.

An illustrative embodiment of the disclosure will be described. FIG. 1 is a plan view of a printer in an illustrative embodiment according to one or more aspects of the disclosure. Referring to FIG. 1, general structures of an inkjet printer 1 will be described. The front, rear, left, and right sides of the printer 1 are defined as depicted in FIG. 1. The front or near side and the back side of the sheet of FIG. 1 are defined as the top/upper side and the bottom/lower side of the printer 1, respectively. Hereinafter, description will be made with reference to directions as defined above.

(General Structures of Printer)

As depicted in FIG. 1, the inkjet printer 1 includes a platen 2, a carriage 3, an inkjet head 4, a feeding mechanism 5, and a controller 6.

A recording medium, e.g., a recording sheet 100, is placed on the upper surface of the platen 2. The carriage 3 is configured to reciprocate along two guide rails 10 and 11 in a scanning direction at a region opposing the platen 2. An endless belt 14 is connected to the carriage 3. As a carriage drive motor 15 drives the endless belt 14, the carriage 3 moves in the scanning direction.

The inkjet head 4 is mounted on the carriage 3. The inkjet head 4 is configured to move together with the carriage 3 in the scanning direction. The inkjet head 4 is connected by tubes (not depicted) to a cartridge holder 7 on which ink cartridges 17 of four colors (e.g., black, yellow, cyan, and magenta) are mounted. The inkjet head 4 includes head units 12 and 13 arranged in the scanning direction. Each head unit 12 and 13 has a plurality of nozzles 24 (refer to FIGS. 2-5D) formed on the lower surface thereof (e.g., the back side of the sheet of FIG. 1). The nozzles 24 are configured to eject ink toward the recording sheet 100 placed on the platen 2. In the two head units 12 and 13, one head unit 12 is configured to eject black and yellow inks. The other head unit 13 is configured to eject cyan and magenta inks.

The feeding mechanism 5 includes two feeding rollers 18 and 19 interposing the platen 2 therebetween in a sheet feeding direction. The feeding mechanism 5 is configured to feed the recording sheet 100 placed on the platen 2 in the sheet feeding direction with the two feeding rollers 18 and 19.

The controller 6 includes a read only memory (ROM), a random access memory (RAM), and an application specific integrated circuit (ASIC) comprising various control circuits. The controller 6 is configured to execute various processing, e.g., printing onto the recording sheet 100, based on programs stored in the ROM, with the ASIC. For example, in print processing, the controller 6 controls, for example, the head units 12 and 13 of the inkjet head 4 and the carriage drive motor 15, based on a print instruction input from an external device, e.g., a personal computer (PC), to print, for example, an image, onto the recording sheet 100. More specifically, an ink ejection operation and a feeding operation are alternately performed. In the ink ejection operation, ink is ejected while the inkjet head 4 is moved together with the carriage 3 in the scanning direction. In the feeding operation, the recording sheet 100 is fed in the sheet feeding direction by a predetermined amount by the feeding rollers 18 and 19.

(Details of Head Units of Inkjet Head)

Figure 2:
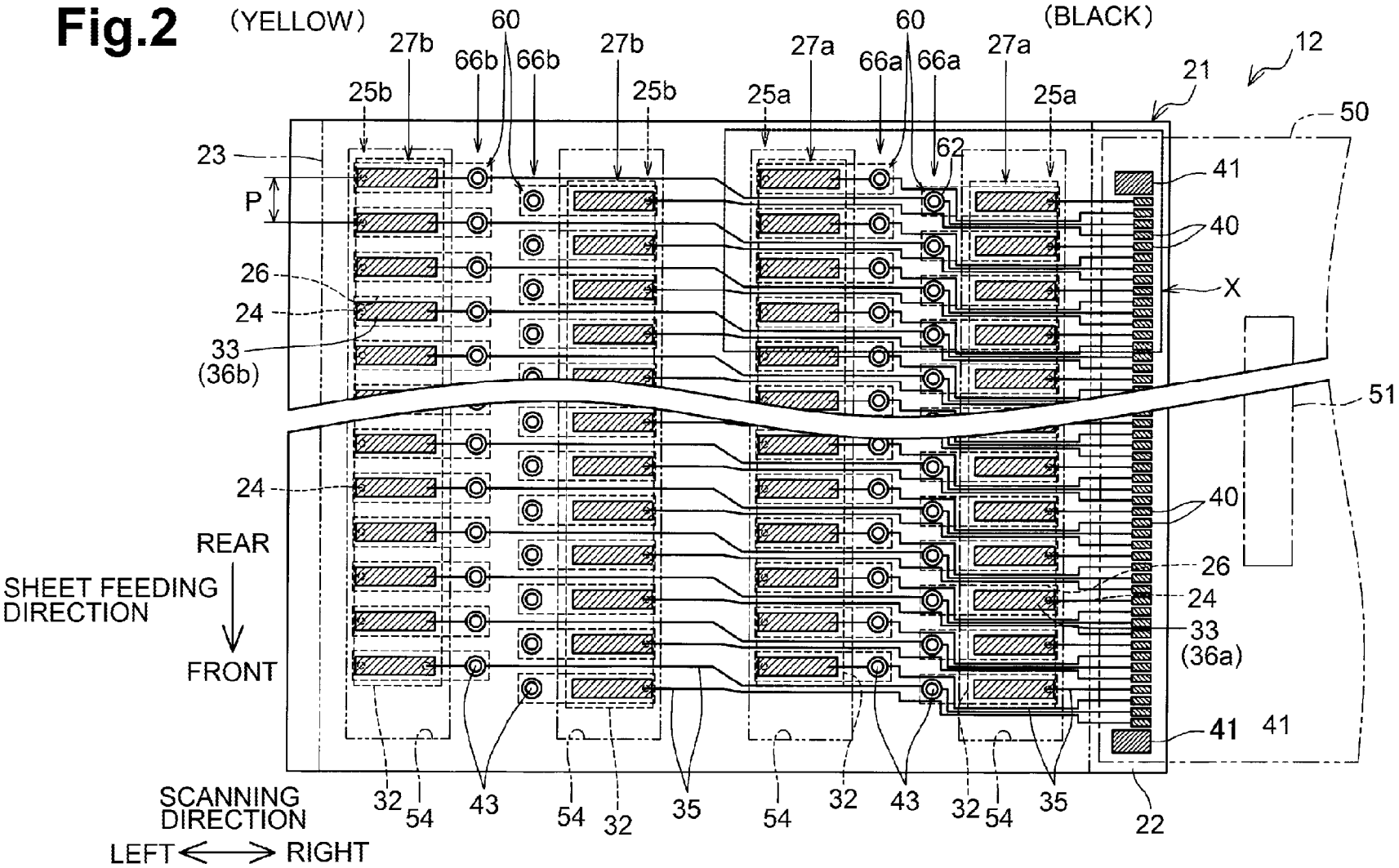
FIG. 2 is a top view of a head unit of an inkjet head.
Figure 3:
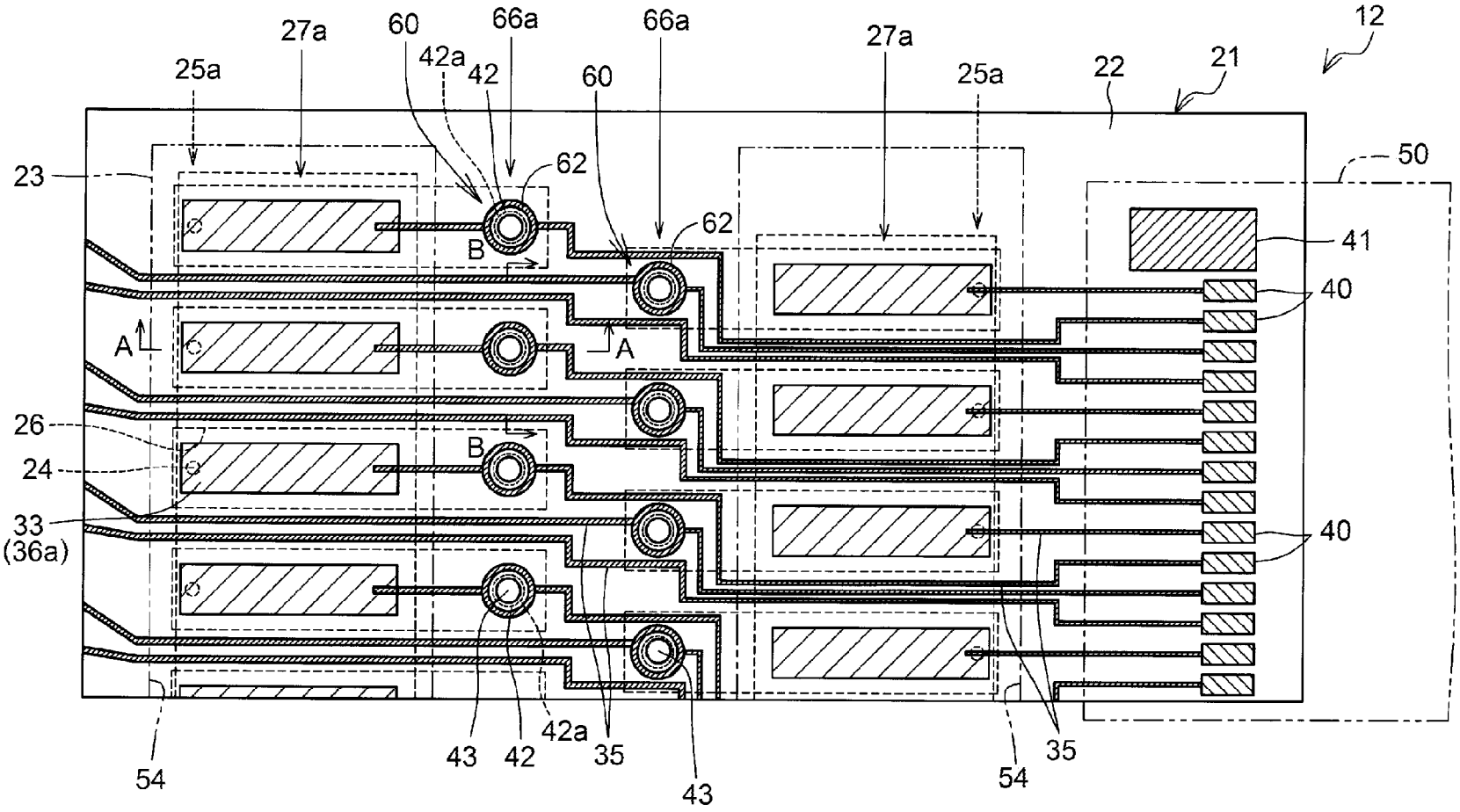
FIG. 3 is an enlarged view of a portion "X" of the head unit of FIG. 2.
Figure 4A:
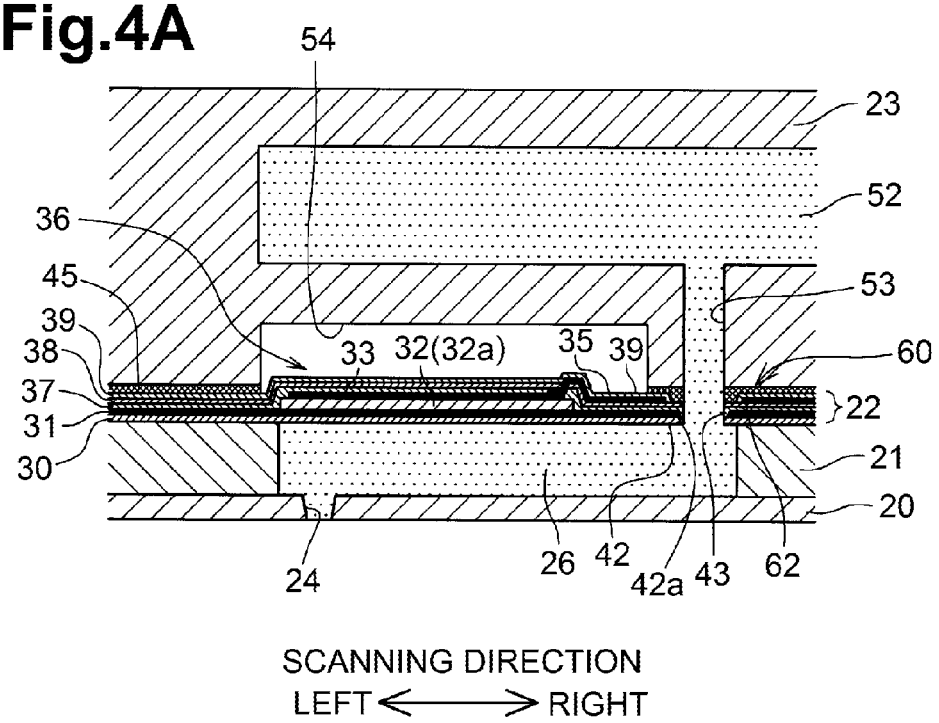
FIG. 4A is a cross-sectional view of the head unit, taken along the line A-A of FIG. 3.
Figure 4B:
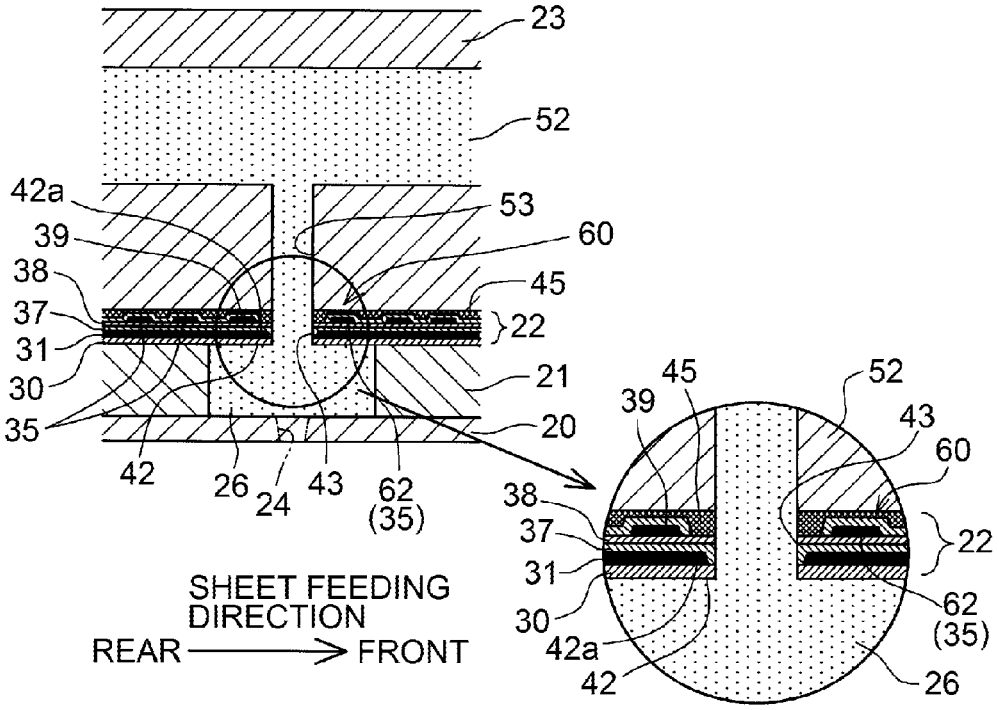
FIG. 4B is a cross-sectional view of the head unit, taken along the line B-B of FIG. 3.

Next, structures of the head units 12 and 13 of the inkjet head 4 will be described in detail. The two head units 12 and 13 have similar structures. Therefore, description will be made in conjunction with the head unit 12 configured to eject black and yellow inks. FIG. 2 is a top view of the head unit 12 of the inkjet head 4. FIG. 3 is an enlarged view of a portion "X" of the head unit of FIG. 2. FIG. 4A is a cross-sectional view of the head unit 12, taken along the line A-A of FIG. 3. FIG. 4B is a cross-sectional view of the head unit 12, taken along the line B-B of FIG. 3. As depicted in FIGS. 2-4B, the head unit 12 includes a nozzles plate 20, a channeled member 21, a laminated body 22, and a reservoir formation member 23. In FIGS. 2 and 3, an outline of the reservoir formation member 23 disposed above the channeled member 21 and the laminated body 22 is illustrated by chain double-dashed lines, for the sake of simplification of the drawings.

(Nozzles Plate)

The nozzles plate 20 is formed of, for example, metallic material, e.g., stainless steel, silicon, or synthetic resin material, e.g., polyimide. As depicted in FIGS. 4A and 4B, the nozzles plate 20 has the nozzles 24. The nozzles 24 are arranged in the sheet feeding direction. The nozzles 24 constitute four nozzle rows 25 arranged in the scanning direction. Right two nozzle rows 25*a* are configured to eject black ink. Positions of the nozzles 24 of the two nozzle rows 25*a* are mutually deviated in the sheet feeding direction by a half of the alignment pitch P (P/2) for each nozzle row 25. Left two nozzle rows 25*b* are configured to eject yellow ink. Similar to the nozzle rows 25*a* for black ink, positions of the nozzles 24 of the two nozzle rows 25*b* for yellow ink are mutually deviated in the sheet feeding direction by a half pitch (P/2).

(Channeled Member)

The channeled member 21 is formed of silicon. The nozzles plate 20 is bonded to the lower surface of the channeled member 21. The channeled member 21 includes a plurality of pressure chambers 26 communicating with the corresponding nozzles 24. Each pressure chamber 26 has a rectangular planar shape elongated in the scanning direction. The pressure chambers 26 are arranged in the sheet feeding direction in association with the nozzles 24. The pressure chambers 26 constitute four pressure chamber rows 27 arranged in the scanning direction. Right two pressure chamber rows 27*a* are for black ink and left two pressure chamber rows 27*b* are for yellow ink. In the left pressure chamber row 27 of the two pressure chamber rows 27*a* (or 27*b*) configured to eject the same color of ink, a left end portion of each pressure chamber 26 and the corresponding nozzle 24 overlap with each other. In the right pressure chamber row 27 of the two pressure chamber rows 27*a* (or 27*b*) configured to eject the same color of ink, a right end portion of each pressure chamber 26 and the corresponding nozzle 24 overlap with each other. Positions of the pressure chambers 26 of the two pressure chamber rows 27*a* for black ink are mutually deviated in the sheet feeding direction by a half pitch (P/2). Positions of the pressure chambers 26 of the two pressure chamber rows 27*b* for yellow ink are also mutually deviated in the sheet feeding direction by a half pitch (P/2).

(Laminated Body)

The laminated body 22 is configured to apply, to ink in the pressure chambers 26, ejection energy for ejecting ink from the respective nozzles 24. The laminated body 22 is disposed at the upper surface of the channeled member 21. As depicted in FIGS. 2-4B, the laminated body 22 is formed by laminating, for example, a vibration plate 30, a common electrode 31, a piezoelectric layer 32, an individual electrode 33, and a drive wiring 35, in layers. As will be briefly described later, the laminated body 22 is formed by sequentially laminating a very thin layer of a few or a several μ m by a known semiconductor process technique on the upper surface of a silicon substrate, which becomes the channeled member 21.

The vibration plate 30 is disposed at the entire upper surface of the channeled member 21 to cover the pressure chambers 26. The vibration plate 30 is formed of, for example, silicon dioxide film (SiO2) or silicon nitride film (SiN). The vibration plate 30 has an opening formed at an end portion thereof opposite to the nozzle 24 of the pressure chamber 26 in the scanning direction.

The common electrode 31 is formed of conductive material, e.g., platinum or titanium. The common electrode 31 is formed almost at an entire upper surface of the vibration plate 30 across the pressure chambers 26.

Four pieces of the piezoelectric layer 32 are disposed at the upper surface of the vibration plate 30 having the common electrode 31 formed thereon in correspondence with the four pressure chamber rows 27. Each piece of the piezoelectric layer 32 extends in the sheet feeding direction across the pressure chambers 26 constituting the one pressure chamber row 27. The piezoelectric layer 32 is formed of piezoelectric material having a main component of, for example, lead zirconate titanate, which is a mixed crystal of lead titanate and lead zirconate.

A plurality of individual electrodes 33 is formed at portions of the upper surface of the piezoelectric layer 32 that overlap the respective pressure chambers 26. Each individual electrode 33 has a planar rectangular shape elongated in the scanning direction. The individual electrodes 33 are formed of conductive material, e.g., platinum, or iridium oxide.

A portion of the piezoelectric layer 32 sandwiched between the individual electrodes 33 and the common electrode 31 is polarized downward in a thickness direction of the piezoelectric layer 32 e.g., a direction from the individual electrodes 33 toward the common electrode 31. The polarized portion of the piezoelectric layer 32 is referred to as the active portion 32*a*. The one active portion 32*a* of the piezoelectric layer 32, and the individual electrode 33 and the common electrode 31 that sandwich the active portion 32*a* constitute one piezoelectric element 36 disposed opposite to the one pressure chamber 26, relative to the vibration plate 30.

As depicted in FIGS. 4A and 4B, two protective layers 37 and 38 are formed on the upper surface of the vibration plate 30, to cover the common electrode 31, the piezoelectric layer 32, and the individual electrodes 33. The protective layers 37 and 38 are not illustrated in FIGS. 2 and 3 for the sake of simplicity. The protective layer 37 includes an insulator formed of, for example, alumina ($Al_2O_3$) or silicon nitride film. The protective layer 38 includes an insulator formed of, for example, silicon dioxide film. The protective layers do not have to include two protective layers 37 and 38 but may include, for example, one protective layer 38 formed of silicon dioxide film.

A plurality of the drive wirings 35 is disposed at the upper surface of the protective layer 38. One end of each drive wiring 35 is connected to the upper surface of a right end portion of the individual electrode 33. Each drive wiring 35 extends rightward from the individual electrode 33. The drive wirings 35 are covered by a protective layer 39 formed of, for example, silicon dioxide film. In FIGS. 2 and 3, the protective layer 39 is not illustrated. As depicted in FIGS. 2 and 3, a plurality of drive contact portions 40 is arranged in one row along the sheet feeding direction at the upper surface of a right end portion of the laminated body 22. The drive wirings 35 extending rightward from the respective individual electrodes 33 are connected to the respective drive contact portions 40 positioned at right end portions of the channeled member 21. A ground contact portion 41 disposed at each side of the drive contact portions 40 in the sheet feeding direction is connected to the common electrode 31.

As depicted in FIGS. 4A and 4B, each of the protective layers 37, 38 and 39 has an opening at an area corresponding to an opening formed on the vibration plate 30, to overlap the opening of the vibration plate 30 in the vertical direction. In other words, the laminated body 22 has a communication opening 43 defined by the openings formed on each of the vibration plate 30 and the protective layers 37, 38 and 39. As depicted in FIGS. 3-4B, the communication opening 43 of the laminated body 22 is formed to be positioned inside the edges of the pressure chamber 26 and within the pressure chamber 26 in plan view. A structure of a portion of the laminated body 22 around the communication opening 43 will be described in detail below.

As depicted in FIGS. 2 and 3, a wiring member, e.g., a chip on film (COF) 50, is bonded to the upper surface of a right end portion of the laminated body 22. A plurality of wirings formed on the COF 50 is electrically connected to the drive contact portions 40. A side of the COF 50 opposite to the laminated body 22 is connected to the controller 6 (refer to FIG. 1) of the printer 1. The driver IC 51 is mounted on the COF 50.

The driver IC 51 generates and outputs a drive signal for driving the piezoelectric element 36, based on a control signal sent from the controller 6. The drive signal output from the driver IC 51 is input to the drive contact portion 40, via a wiring of the COF 50, and supplied to the individual electrode 33 of each piezoelectric element 36, via the drive wiring 35 of the laminated body 22. The potential of the individual electrode 33 to which the drive signal is supplied changes between a predetermined drive potential and the ground potential. A ground wiring is formed on the COF 50. The ground wiring is electrically connected to the two ground contact portions 41 of the laminated body 22. Thus, the potential of the common electrode 31 connected to the ground contact portions 41 is constantly maintained at the ground potential.

Operations of the piezoelectric element 36 when a drive signal is supplied from the driver IC 51 will be described. When a drive signal is not supplied, the potential of the individual electrode 33 of the piezoelectric element 36 is at the ground potential, which is the same potential as the common electrode 31. In this state, as a drive signal is supplied to a certain individual electrode 33 of the piezoelectric element 36, and the drive potential is applied to the individual electrode 33, an electric field parallel to the thickness direction of the active portion 32*a* is applied to the active portion 32*a* of the piezoelectric element 36, due to the potential difference between the individual electrode 33 and the common electrode 31. The polarized direction of the active portion 32*a* and the direction of the electric field match. Therefore, the active portion 32*a* expands in its thickness direction, e.g., the polarized direction, and shrinks in its planar direction. In association with the shrinking deformation of the active portion 32*a*, the vibration plate 30 deforms convexly toward the pressure chamber 26. Thus, the volumetric capacity of the pressure chamber 26 is reduced and a pressure wave is generated in the pressure chamber 26. Accordingly, an ink droplet is ejected from the nozzle 24 communicating with the pressure chamber 26.

(Reservoir Formation Member)

The reservoir formation member 23 is disposed at a side (e.g., an upper side) opposite to the channeled member 21 relative to the laminated body 22. The reservoir formation member 23 is bonded to the upper surface of the laminated body 22 with an adhesive 45. The reservoir formation member 23 may be formed of, for example, silicon, similar to the channeled member 21, or other material than silicon, e.g., metallic material or synthetic resin material.

Two reservoirs 52 are formed at an upper half portion of the reservoir formation member 23. Each reservoir 52 extends in the sheet feeding direction. The two reservoirs 52 are arranged along the scanning direction. The two reservoirs 52 are connected by the tubes (not depicted) to the cartridge holder 7 (refer to FIG. 1) configured to hold the cartridges 17. Black ink is supplied to one of the two reservoirs 52 and yellow ink is supplied to the other one of the two reservoirs 52.

A plurality of ink supply channels 53 extending downward from each reservoir 52 is formed at a lower half portion of the reservoir formation member 23. Each ink supply channel 53 communicates with the corresponding pressure chamber 26 of the channeled member 21, via the communication opening 43 of the laminated body 22. Thus, ink is supplied to the pressure chambers 26 of the channeled member 21 from each reservoir 52, via the ink supply channels 53 and the communication openings 43. Four protective cover portions 54 of a concave or recessed shape is formed at a lower half portion of the reservoir formation member 23. Each protective cover portion 54 covers corresponding one of four piezoelectric element rows of the laminated body 22.

(Structures of Surrounding of Communication Opening of Laminated Body)

Next, structures of a surrounding of the communication opening 43 of the laminated body 22 will be described in detail. As depicted in FIGS. 4A and 4B, the reservoir formation member 23 is bonded to areas of the laminated body 22 around the communication openings 43 with the adhesive 45.

A plurality of annular wall portions 60 is disposed at a portion of the laminated body 22 around the respective communication openings 43 to surround the respective communication openings 43. Each annular wall portion 60 protrudes upward. Each annular wall portion 60 includes an annular conductive portion 62 formed on the upper surface of the protective layer 38 to surround the communication opening 43. The one annular wall portion 60 is constituted by the annular conductive portion 62 covered by the protective layer 39. With such structure, the reservoir formation member 23 is bonded to the vibration plate 30 (e.g., the laminated body 22) while being pressed against the annular wall portions 60 at areas around the communication openings 43. Therefore, the sealability or effectiveness of seal around the communication openings 43 may be favorable and ink leakage from the bonded portions may be prevented or reduced. The planar shape of the annular wall portion 60 is not limited to a particular shape as long as the annular wall portion 60 surrounds the communication opening 43. The planar shape of the annular wall portion 60 may be, for example, an elliptical shape, or a rectangular frame, in addition to a circular shape concentric with the communication opening 43 as depicted in FIG. 3.

The conductive portion 62 constitutes a portion of the one drive wiring 35 connecting the one piezoelectric element 36 to the one drive contact portion 40, in a portion of the annular wall portions 60, more specifically, the annular wall portions 60 corresponding to the communication openings 43 belonging to the left and right communication opening rows 66*a* for black ink, and a left communication opening row 66*b* for yellow ink, as depicted in FIG. 2. In other words, in these annular wall portions 60, a portion of the drive wiring 35 is disposed in the annular wall portion 60 and the drive wiring 35 is not disposed to avoid each annular wall portion 60. For the communication openings 43 belonging to a right communication opening row 66*b* for yellow ink, the corresponding conductive portions 62 of the annular wall portions 60 are independently provided from the neighboring drive wirings 35 and are not electrically connected to any drive wirings 35.

As depicted in FIGS. 4A and 4B, a portion of the laminated body 22 faces the pressure chambers 26 in the channeled member 21. In the portion of the laminated body 22 facing the pressure chambers 26 in the channeled member 21, especially, a portion surrounding the communication opening 43 is hereinafter referred to as "the circumferentially facing portion 42."

The circumferentially facing portions 42 of the laminated body 22 do not contact the upper surface of the channeled member 21. In other words, the circumferentially facing portions 42 are not supported by the channeled member 21. Therefore, when an external force is applied to the circumferentially facing portions 42 due to factors as described below, the circumferentially facing portions 42 may be readily damaged.

The circumferentially facing portions 42 are disposed around the corresponding communication openings 43 of the laminated body 22, so that a pressure of ink flowing into the communication openings 43 is applied. When the reservoir formation member 23 is bonded to portions of the laminated body 22 around the communication openings 43 with the adhesive 45, shrinkage force of the adhesive 45 is applied to the circumferentially facing portions 42.

Each communication opening 43 brings the reservoir 52 and the respective pressure chamber 26 into communication with each other. Each communication opening 43 is disposed adjacent to the relevant piezoelectric element 36. The circumferentially facing portions 42 disposed around the respective communication openings 43 oppose the corresponding pressure chambers 26. Therefore, when the piezoelectric elements 36 are driven, vibrations generated in the vibration plate 30 are applied to the circumferentially facing portions 42. The laminated body 22 according to the illustrative embodiment may be readily broken even with a small external force, because the laminated body 22 is manufactured by laminating very thin inorganic material films manufactured by semiconductor processes.

As described above, the annular wall portion 60 is disposed at a portion of the laminated body 22 around the communication opening 43. Therefore, as depicted in FIGS. 4A and 4B, when the reservoir formation member 23 is bonded to the laminated body 22 by pressing against the annular wall portions 60, a portion of the circumferentially facing portion 42 of the laminated body 22 inside the annular wall portion 60 (e.g., a portion closer to the communication opening 43) does not directly contact the channeled member 21 or the reservoir formation member 23. If the adhesive 45 is sufficiently filled up in a space between a portion of the circumferentially facing portion 42 inside the annular wall portions 60 and the reservoir formation member 23, the circumferentially facing portion 42 may be less susceptible to damages. However, the adhesive 45 might not be sufficiently filled up in the space. Thus, the circumferentially facing portion 42 is more susceptible to damages because the annular wall portion 60 is disposed away from the communication opening 43 around the communication opening 43.

In the illustrative embodiment, the circumferentially facing portion 42 disposed at a portion of the laminated body 22 around the communication opening 43 includes a metallic layer 42*a*. The metallic layer 42*a* reinforces the circumferentially facing portion 42. More specifically, as depicted in FIGS. 4A and 4B, a portion of the common electrode 31 disposed at the upper surface of the vibration plate 30 extends from an area outside the annular wall portion 60 to an area inside the annular wall portion 60 at a portion around the communication opening 43, to constitute the metallic layer 42*a*. In other words, the metallic layer 42*a* of the circumferentially facing portion 42 is disposed at the upper surface of the vibration plate 30, on the same plane as the common electrode 31. The metallic layer 42*a* is electrically connected with the common electrode 31.

Thus, as each of the circumferentially facing portions 42 includes the metallic layer 42*a*, the metallic layer 42*a* reinforces the corresponding circumferentially facing portion 42, which is disposed around the communication opening 43 and susceptible to damages. Therefore, the circumferentially facing portions 42 may be less susceptible to damages. The metallic layers 42*a* (e.g., pieces or portions of the metallic layer 42*a*) are disposed on a same plane as the common electrode 31 disposed at the upper surface of the vibration plate 30. The common electrode 31 and the metallic layers 42*a* (e.g., pieces or portions of the metallic layer 42*a*) may be formed at one time on the flat upper surface of the vibration plate 30.

The metallic layer 42*a* is electrically connected to the common electrode 31. Therefore, the metallic layer 42*a* has the same potential (e.g., the ground potential) as the common electrode 31. As depicted in FIGS. 4A and 4B, the metallic layer 42*a* is disposed at a portion of the circumferentially facing portion 42 away from the edge of the communication opening 43. Further, the metallic layer 42*a* is covered by the protective layer 37 formed of an insulating material. The metallic layer 42*a* is not exposed at the edge of the communication opening 43. Thus, ink flowing into the communication opening 43 does not contact the metallic layer 42*a*. Therefore, such a problem, e.g., short circuit, may be reliably prevented or reduced that is caused, via conductive ink, between the drive wiring 35 to which the drive potential is applied and the metallic layer 42*a* having the ground potential.

The metallic layer 42*a*, which is a portion of the common electrode 31, extends from the circumferentially facing portion 42 opposing or facing the pressure chamber 26 to a portion of the laminated body 22 contacting the channeled member 21. In other words, the metallic layer 42*a* extends from the circumferentially facing portion 42 that is not supported by the channeled member 21 to a portion of the laminated body 22 supported by the channeled member 21. Therefore, even when pressure of ink flowing into the communication opening 43 is applied to the circumferentially facing portion 42, the circumferentially facing portion 42 may be difficult to break at a boundary of a portion of the laminated body 22 supported by the channeled member 21.

The metallic layer 42*a* extends to a portion of the circumferentially facing portion 42 inside the annular wall portion 60. As described above, a portion of the circumferentially facing portion 42 inside the annular wall portion 60 does not directly contact the channeled member 21 or the reservoir formation member 23, and is not supported by any members. Therefore, a portion of the circumferentially facing portion 42 inside the annular wall portion 60 may be readily damaged. As the metallic layer 42*a* is disposed at a portion of the circumferentially facing portions 42 inside the annular wall portion 60, damages on the circumferentially facing portion 42 may be effectively prevented or reduced.

As depicted in FIGS. 2-4B, in the illustrative embodiment, all of the perimeter of the edge of the communication opening 43 is disposed inside the edges of the corresponding pressure chamber 26 communicating with the communication opening 43. In other words, the communication opening 43 is disposed within the pressure chamber 26 when viewed from above. According to the illustrative embodiment, the communication opening 43 constitutes a portion of an ink supply channel for supplying ink from the reservoir 52 to the respective pressure chamber 26. It is preferred that the resistance of the ink supply channel is great to some extent to prevent pressure waves occurred in the respective pressure chamber 26 from propagating and escaping to the reservoir 52. In the illustrative embodiment, to increase the resistance of the ink supply channel, the diameter of the communication opening 43 is formed small to fit in the pressure chamber 26.

The communication opening 43 is disposed to fit in the pressure chamber 26 as described above, and a portion of the laminated body 22 extends inward from edges of the pressure chamber 26 in a circumferential direction of the communication opening 43 all around the communication opening 43. In other words, a portion all around the communication opening 43 becomes the circumferentially facing portions 42 facing the pressure chamber 26. Therefore, damages may occur at any portion of the circumferentially facing portion 42 in its circumferential direction. In the illustrative embodiment, the metallic layer 42*a* (e.g., a portion of the common electrode 31) of the circumferentially facing portion 42 is formed to surround the communication opening 43. Thus, the circumference of the circumferentially facing portion 42 is reinforced by the metallic layer 42*a*.

Next, a method for manufacturing the head unit 12 of the inkjet head 4 will be described. FIGS. 5A-5D depict manufacturing processes of the head unit 12.

(a) Forming Laminated Body 22

Figure 5A:
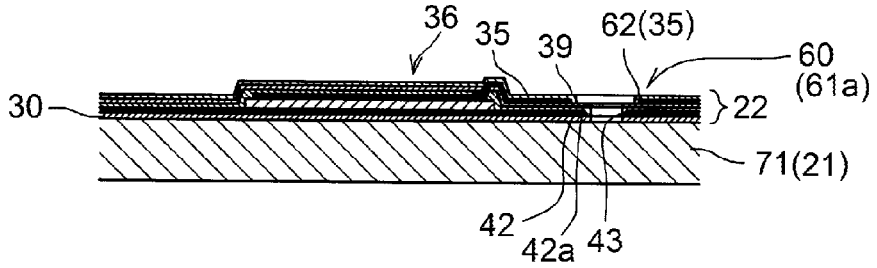
FIGS. 5A-5D illustrate manufacturing processes of the head unit.

As depicted in FIG. 5A, the laminated body 22 is formed on the upper surface of a silicon substrate 71, which becomes the channeled member 21. The laminated body 22 is formed using a known semiconductor process technique. To put it briefly, a film that becomes the respective layer of the laminated body 22 is sequentially formed, using a known film or layer formation technique, such as the spattering method or sol-gel method. Unnecessary portions of the film are removed at an appropriate timing, for example, by etching, to form the laminated body 22.

In the processes of forming the laminated body 22, when the common electrode 31 is formed on the upper surface of the vibration plate 30, the metallic layer 42*a* of the circumferentially facing portions 42 is formed at the same process as the common electrode 31 by extending a portion of the common electrode 31 to a portion around the opening of the vibration plate 30, which constitutes a portion of the communication opening 43. The annular wall portions 60 are formed on the upper surface of portions of the laminated body 22 around the respective communication openings 43.

(b) Bonding Reservoir Formation Member 23

Figure 5B:
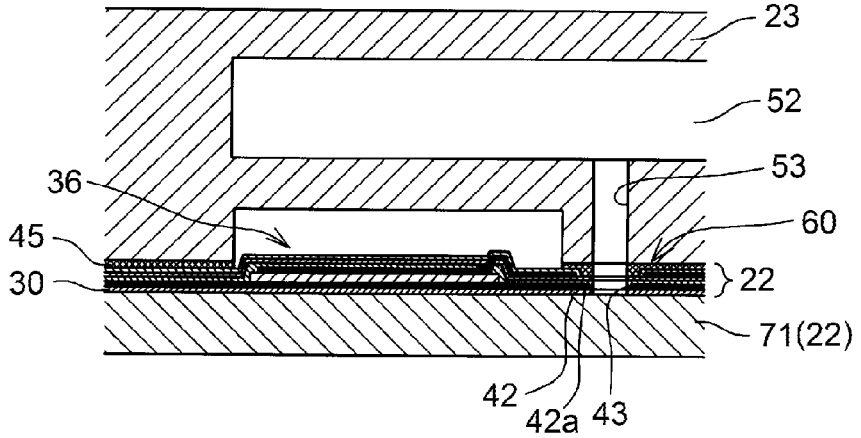

As depicted in FIG. 5B, the reservoir formation member 23 having the reservoirs 52 and ink supply channels 53 formed thereon is pressed against the upper surface of the laminated body 22 to bond with the thermosetting adhesive 45. At this time, the reservoir formation member 23 is bonded while being pressed against the annular wall portions 60 in portions of the laminated body 22 around of the communication openings 43. Thus, all perimeters of the reservoir formation member 23 may be reliably bonded at portions around the communication opening 43, and the sealability or effectiveness of seal may be preferable.

(c) Forming Channels in Channeled Member 21

Figure 5C:
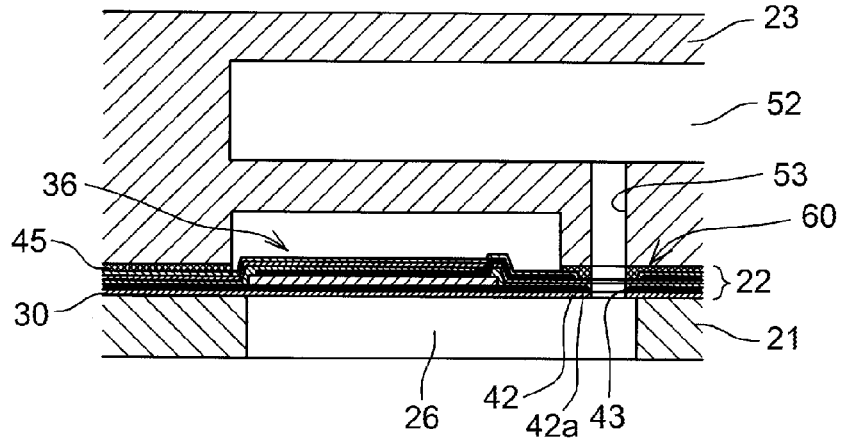

As depicted in FIG. 5C, channels, e.g., the pressure chambers 26, are formed on the silicon substrate 71, for example, by etching. Thus, the silicon substrate 71 becomes the channeled member 21.

As described above, in the illustrative embodiment, the communication opening 43 of the laminated body 22 is formed within the pressure chambers 26. A portion of the laminated body 22 extends inward from edges of the pressure chamber 26 in the circumferential direction of the communication opening 43. In this case, if the reservoir formation member 23 is bonded while being pressed against the annular wall portions 60 of the laminated body 22 after the pressure chambers 26 are formed on the channeled member 21, the channeled member 21 (e.g., the silicon substrate 71) might not bear the pressing force to the annular wall portions 60. Therefore, a portion of the laminated body 22 extending inwardly from edges of the pressure chamber 26 may be damaged. In this regard, in the illustrative embodiment after the reservoir formation member 23 is bonded to the laminated body 22, as depicted in FIG. 5B, the pressure chambers 26 are formed on the channeled member 21 as depicted in FIG. 5C. In other words, when the reservoir formation member 23 is bonded as depicted in FIG. 5B, the pressure chambers 26 are not formed on the channeled member 21 (e.g., the silicon substrate 71). Therefore, pressing force applied to the annular wall portions 60 of the laminated body 22 is received by the channeled member 21. Accordingly, the laminated body 22 is less subjected to damages at the time of bonding the reservoir formation member 23.

(d) Bonding Nozzles Plate 20

Figure 5D:
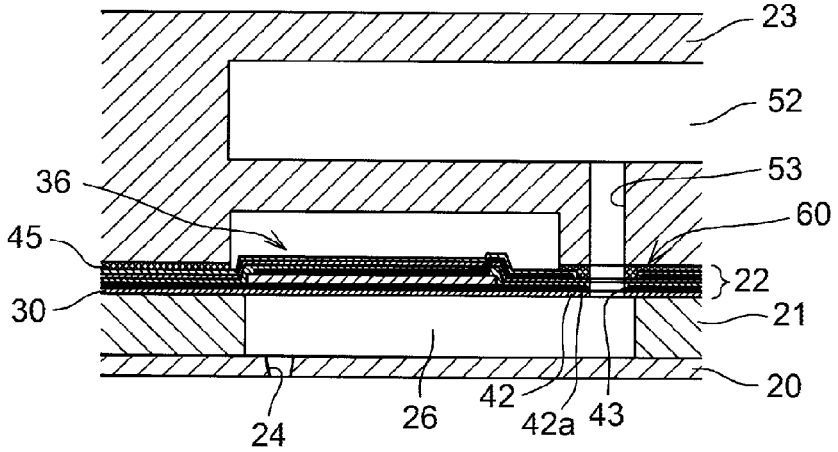

Lastly, as depicted in FIG. 5D, the nozzles plate 20 having the nozzles 24 formed thereon is bonded to the lower surface of the channeled member 21 with the adhesive 45.

In the above-described illustrative embodiment, the inkjet head 4 corresponds to a liquid ejection apparatus of the disclosure. The channeled member 21 and the nozzles plate 20 correspond to a first channeled structure of the disclosure. The nozzles 24 formed on the nozzles plate 20 and the pressure chambers 26 formed on the channeled member 21 correspond to a first liquid channel of the disclosure. The reservoir formation member 23 corresponds to a second channeled structure of the disclosure. The reservoir 52 of the reservoir formation member 23 and the ink supply channel 53 correspond to a second liquid channel of the disclosure. A plurality of the individual electrodes 33 corresponds to a plurality of second electrodes of the disclosure. Portions of the common electrode 31 (e.g., a portion contacting the active portion 32*a*) opposing the respective individual electrodes 33 corresponds to a plurality of first electrodes of the disclosure.

Next, modifications of the above-described illustrative embodiment will be described. Like reference numerals denote like corresponding parts and detailed description thereof with respect to the following modifications will be omitted herein.

Figure 6A:
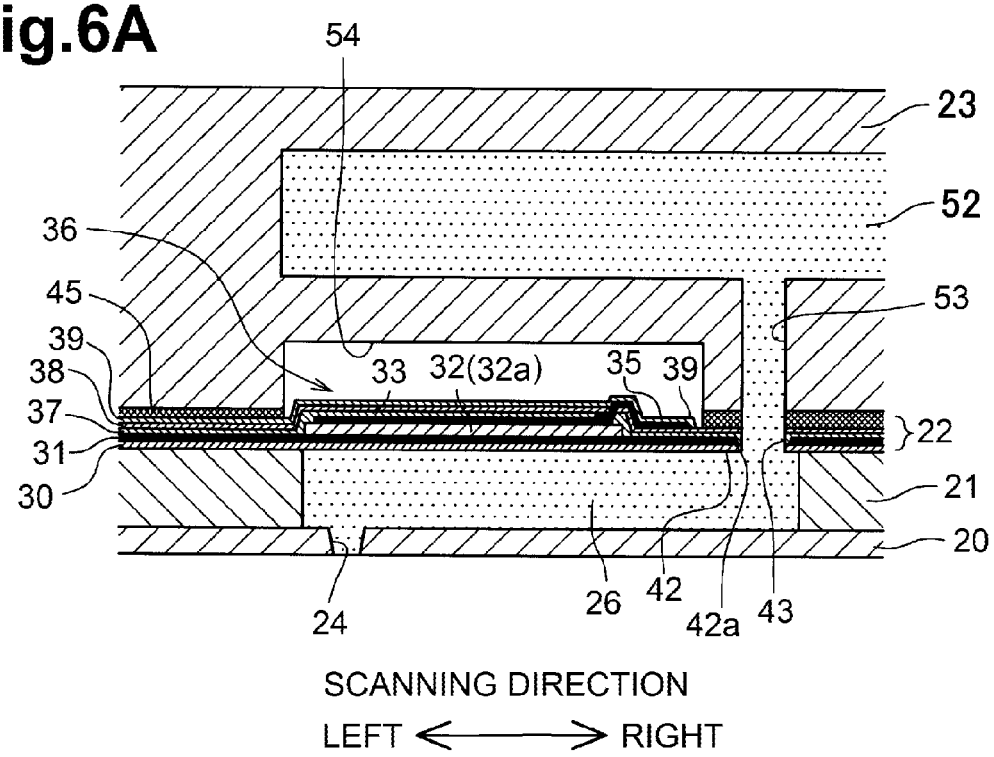
FIGS. 6A and 6B are cross-sectional views of a head unit in a modification of the illustrative embodiment.
Figure 6B:
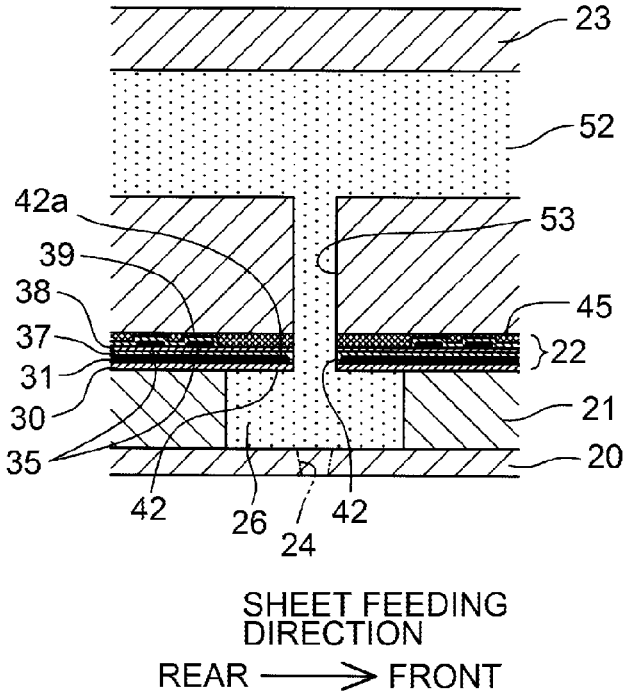

1] In the above-described illustrative embodiment, the annular wall portion 60 including the conductive portion 62 is disposed at a portion of the laminated body 22 around the communication opening 43 to surround the communication opening 43. However, the disclosure is not limited to such structure. For example, the annular wall portion 60 might not include the conductive portion 62. Further, as depicted in FIGS. 6A and 6B, the annular wall portion 60 might not be disposed at a portion of the laminated body 22 around the communication opening 43.

2] In the above-described illustrative embodiment, the metallic layer 42*a* of the circumferentially facing portion 42 of the laminated body 22 is electrically connected the common electrode 31. In another embodiment, the metallic layer 42*a* may be an independent pattern separated from the common electrode 31.

3] In the above-described illustrative embodiment, the metallic layer 42*a* of the circumferentially facing portions 42 is disposed on the same plane as the common electrode 31 closer to the vibration plate 30 than the electrode 33 of the piezoelectric element 36. The metallic layer 42*a* is formed in the same process as the common electrode 31. In another embodiment, the metallic layer 42*a* may be formed in the same process as the individual electrodes 33 disposed opposite to the vibration plate 30 relative to the piezoelectric layer 32.

Figure 7:
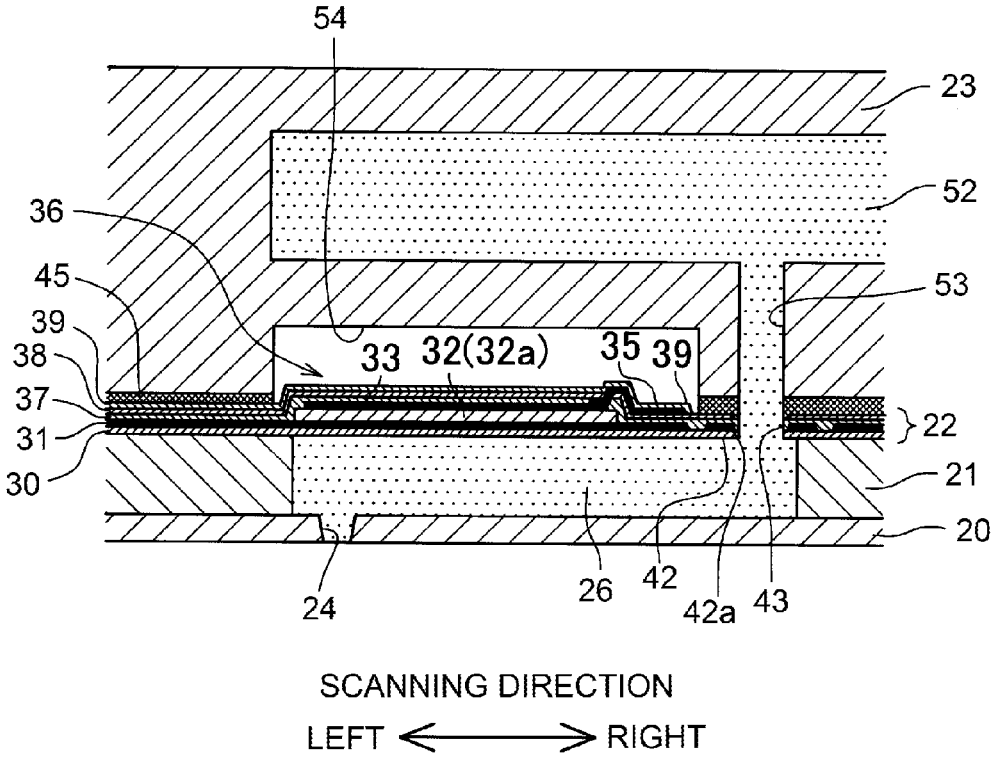
FIG. 7 is a cross-sectional view of a head unit in another modification of the illustrative embodiment.

For example, in FIG. 7, the metallic layer 42*a* of the circumferentially facing portion 42 may be separated from the common electrode 31. The metallic layer 42*a* may be formed in a process to form the individual electrodes 33 at the same time as the individual electrodes 33 after the piezoelectric layer 32 is formed. In another embodiment, the circumferentially facing portion 42 may include two metallic layers 42*a*, e.g., the metallic layer 42*a* formed in the same process as the individual electrodes 33 and the metallic layer 42*a* formed in the same process as the common electrode 31.

4] It may be determined whether the metallic layer 42*a* of the circumferentially facing portion 42 is formed in the same process as the common electrode 31 or the individual electrodes 33, based on material characteristics of the common electrode 31 and the individual electrodes 33.

For example, the metallic layer 42*a* may be formed in the same process as one of the common electrode 31 and the individual electrode 33 having a greater thickness. In this case, as the metallic layer 42*a* is formed at the same time as one of the common electrode 31 and the individual electrode 33 having a greater thickness, the thickness of the metallic layer 42*a* may become greater. Therefore, the strength of the circumferentially facing portions 42 of the laminated body 22 may further be increased.

In another embodiment, the metallic layer 42*a* may be formed in the same process as one of the common electrode 31 and the individual electrode 33 formed of a material having a greater yield stress. A material having a greater yield stress means that a range of elastic deformation of the material is greater, and the material is difficult to break even with the application of a great external force. Therefore, as the metallic layer 42*a* is formed at the same time as one of the common electrode 31 and the individual electrode 33 having a greater yield stress, the yield stress of the metallic layer 42*a* may be increased. Therefore, when external force is applied to the circumferentially facing portions 42 of the laminated body 22, the circumferentially facing portions 42 may be difficult to be damaged.

When the metallic layer 42*a* of the circumferentially facing portion 42 is formed in the same process as the common electrode 31 or the individual electrodes 33, the metallic layer 42*a* might not be necessarily disposed on the same plane as the common electrode 31 or the individual electrodes 33 formed in the same process.

Figure 8A:
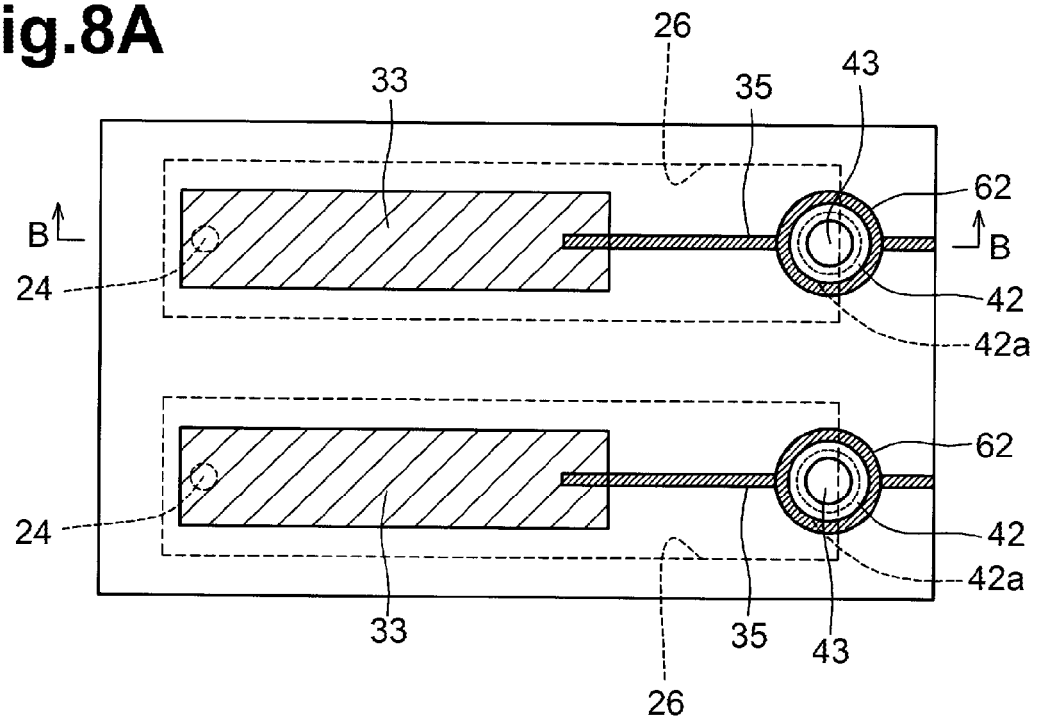
FIG. 8A is a partially enlarged plan view of a head unit in yet another modification of the illustrative embodiment.
Figure 8B:
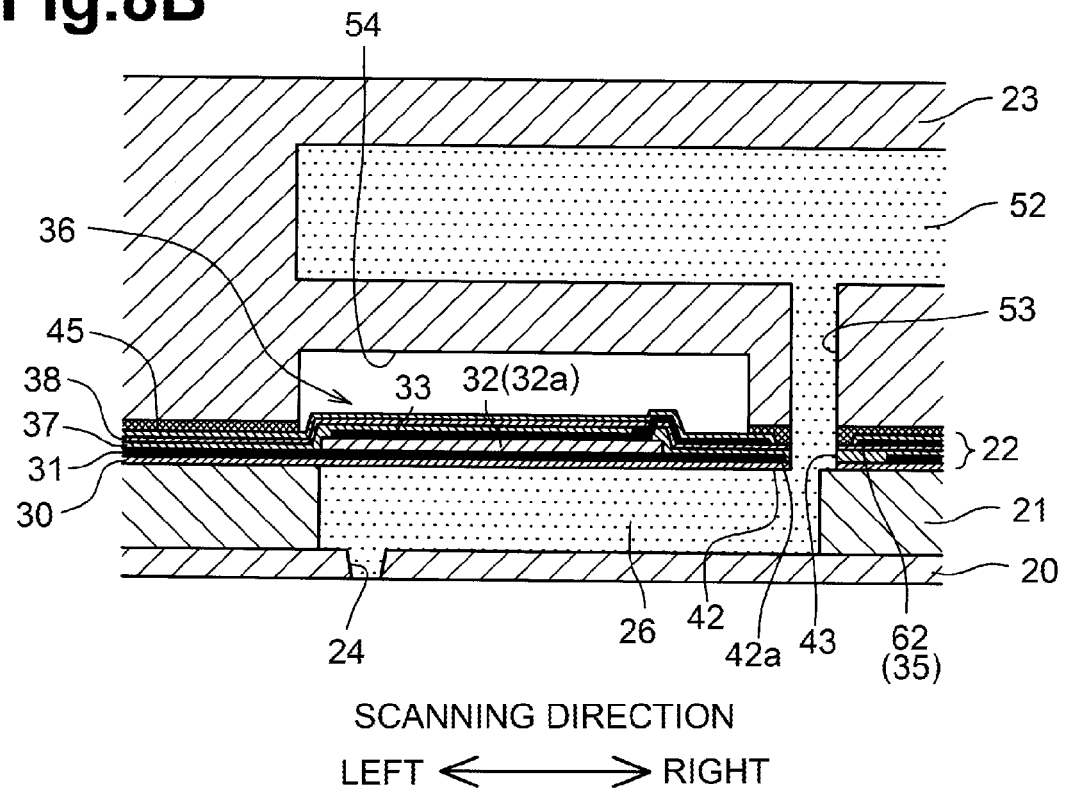
FIG. 8B is a cross-sectional view of the head unit, taken along the line B-B of FIG. 8A.

5] In the above-described illustrative embodiment, the communication opening 43 is disposed inside edges of the pressure chamber 26 within the pressure chamber 26. In another embodiment, as depicted in FIGS. 8A and 8B, a portion of the communication opening 43 may extend outside an edge of the pressure chamber 26. In the structure of FIGS. 8A and 8B, among a portion of the laminated body 22 around the communication opening 43, a left portion of a portion of the laminated body 22 around the communication opening 43 is the circumferentially facing portion 42 that opposes the pressure chamber 26, and a right portion of a portion of the laminated body 22 around the communication opening 43 may contact the channeled member 21 without opposing the pressure chamber 26. Therefore, as depicted in FIG. 8B, the metallic layer 42*a* of the circumferentially facing portion 42 might not have to surround the communication opening 43, but may be disposed at at least a left portion of a portion of the laminated body 22 around the communication opening 43.

6] Application of the disclosure is not limited to the communication opening 43 through which ink is supplied individually to the each pressure chamber 26. In the head units 12 and 13 according to the above-described illustrative embodiment, the communication openings 43 are formed on the laminated body 22 in correspondence with the respective pressure chambers 26, and ink is supplied to each of the pressure chambers 26 from the reservoirs 52 of the reservoir formation member 23, via the communication openings 43. In another embodiment, for example, one or two communication opening(s) may be formed on the laminated body 22, as in the known apparatus. Ink may be distributed to the pressure chambers 26 in the channeled member 21 after ink in the reservoirs 52 is supplied to the channeled member 21 via the communication opening(s). In other words, ink to be supplied to the pressure chambers 26 may flow in one communication opening. In such structure, a circumferentially facing portion positioned at a portion of the laminated body 22 around communication opening may be damaged by a factor, e.g., flow of ink in the communication opening. Therefore, application of the disclosure may be effective to prevent or reduce damages on the circumferentially facing portion.

7] In the above-described illustrative embodiment, the channeled member 21 is formed of the silicon substrate 71. The laminated body 22 is formed on the silicon substrate 71 with a known semiconductor process technique. In another embodiment, the channeled member 21 may be formed of material other than silicon, e.g., a metallic material. When the channeled member 21 is formed of material other than silicon, the laminated body 22 manufactured in a different process may be bonded to the upper surface of the channeled member 21 with an adhesive.

8] In the above-described illustrative embodiment, the electrode disposed on a side of the piezoelectric layer 32 closer to the vibration plate 30 is the common electrode 31 to which the ground potential is applied. The electrode disposed on the other side of the piezoelectric layer 32 opposite to the vibration plate 30 relative to the piezoelectric layer 32 is the individual electrode 33 to which a drive signal is supplied. In another embodiment, the arrangement of the common electrode 31 and the individual electrode 33 may be reversed.

In the illustrative embodiment and its modifications, the disclosure is applied to an inkjet head configured to eject ink on a recording sheet to print, for example, an image. The disclosure may be applied to a liquid ejection apparatus to be used in a wide variety of uses other than an image printing. For example, the disclosure may be applied to a liquid ejection apparatus configured to eject conductive liquid on a substrate to form conductive patterns on a surface of the substrate.

What is claimed is:

1. A liquid ejection apparatus comprising: a nozzle; a first channeled structure defining a first liquid channel, the first liquid channel communicating with the nozzle; a second liquid channel; a communication opening connecting the first liquid channel and the second liquid channel; a laminated body including a piezoelectric element and a metal layer, the laminated body having a first portion supported by the first channeled structure, the communication opening extending a second portion of the laminated body such that the second portion surrounds the communication opening, wherein the second portion extends over the first liquid channel and is entirely unsupported by the first channeled structure; wherein the second portion of the laminated body includes the metal layer surrounding the communication opening.

2. A liquid ejection apparatus according to claim 1, wherein the second portion of the laminated body is a circumferentially facing portion.

3. A liquid ejection apparatus according to claim 1, wherein the laminated body includes an insulating layer, wherein the insulating layer contacts the first channeled structure in the first portion of the laminated body and the insulating layer does not contact the first channeled structure in the second portion of the laminated body, and wherein the metal layer is disposed on the insulating layer.

4. A liquid ejection apparatus according to claim 1, the meTal layer extends from the first portion to the second portion.

5. A liquid ejection apparatus according to claim 1, wherein the piezoelectric element includes:

a piezoelectric layer;

a first electrode on a first side of the piezoelectric layer;

a second electrode on a second side of the piezoelectric layer opposite the first side.

6. A liquid ejection apparatus according to claim 5, wherein the first electrode is a common electrode and the second electrode is an individual electrode.

7. A liquid ejection apparatus according to claim 5, wherein the metal layer and the first electrode each define a thickness that is greater than a thickness of the second electrode.

8. A liquid ejection apparatus according to claim 5, wherein the metal layer and the first electrode each define a yield stress that is greater than a yield stress of the second electrode.

9. A liquid ejection apparatus according to claim 5, wherein the metal layer is electrically connected with the first electrode or the second electrode.

10. A liquid ejection apparatus according to claim 1, wherein the metallic metal layer is covered with an insulating layer such that the metal layer is not exposed to the communication opening.

11. A liquid ejection apparatus according to claim 1, further comprising a wall extending from a side of the second portion of the laminated body opposite the first liquid channel, wherein the metal layer is closer to the communication opening than the wall.

* * * * *